United States Patent [19]

Melton et al.

[11] 4,365,996

[45] Dec. 28, 1982

[54] METHOD OF PRODUCING A MEMORY ALLOY

[75] Inventors: Keith Melton, Busslingen; Olivier Mercier, Ennetbaden; Helmut Riegger, Busslingen, all of Switzerland

[73] Assignee: BBC Brown, Boveri & Company Limited, Baden, Switzerland

[21] Appl. No.: 239,626

[22] Filed: Mar. 2, 1981

[30] Foreign Application Priority Data

Mar. 3, 1980 [EP] European Pat. Off. ..... 80200184

[51] Int. Cl.[3] ..... C22C 9/01; B22F 1/00

[52] U.S. Cl. ..... 419/28; 148/402; 75/247; 419/44

[58] Field of Search ..... 75/200, 211, 212, 246, 75/247, 249, 139, 162, 226, 221; 148/11.5 R, 11.5 C, 126

[56] References Cited

U.S. PATENT DOCUMENTS

| | | | |
|---|---|---|---|
| 2,210,671 | 8/1940 | Kelly | 75/162 |
| 2,430,419 | 11/1947 | Edens | 75/162 |
| 2,778,733 | 1/1957 | Frejacques | 75/162 |
| 3,091,527 | 5/1963 | Pollock | 75/162 |
| 3,117,002 | 1/1964 | Klement | 75/139 |
| 3,333,950 | 8/1967 | Hill | 75/255 |
| 3,783,037 | 1/1974 | Brook et al. | 148/11.5 R |
| 4,113,475 | 9/1978 | Smith | 75/162 |
| 4,310,354 | 1/1982 | Fountain et al. | 75/246 |

FOREIGN PATENT DOCUMENTS

| | | | |
|---|---|---|---|
| 2825262 | 12/1978 | Fed. Rep. of Germany | 75/246 |
| 2416520 | 10/1979 | France | 75/249 |

*Primary Examiner*—Gary P. Straub

*Attorney, Agent, or Firm*—Oblon, Fisher, Spivak, McClelland & Maier

[57] ABSTRACT

Cu/Al and Cu/Al/Ni memory alloys having improved mechanical properties are prepared by powder metallurgy from mixtures of pre-alloyed and/or pre-mixed powder ingredients. The mixture of powder ingredients is subjected successively to isostatic pressing, sintering in an inert atmospheric and subsequent multi-step hot working with intermediate annealing which serves to homogenize. Final annealing is carried out in the $\beta$-phase solid solution temperature range and the annealed article is quenched in water.

9 Claims, No Drawings

METHOD OF PRODUCING A MEMORY ALLOY

BACKGROUND OF THE INVENTION

1. Field of the Invention

This invention relates to memory alloys and more particularly to a method of producing memory alloys using powder metallurgy.

2. Description of the Prior Art

Memory alloys based on the Cu/Al/Ni system are known and have been described in various publications (e.g., U.S. Pat. No. 3,783,037). Such memory alloys which belong generally to the type having a $\beta$-high temperature phase, are usually produced by fusion techniques.

When these alloys are cast they usually exhibit a coarse texture which becomes still coarser because of grain growth during the subsequent annealing in the temperature range of the $\beta$-phase solid solution and which cannot be reversed by hot working. As a result, the mechanical characteristics, particularly elongation and notch ductility, of memory alloys produced in this manner are relatively poor and their field of application is limited.

It has already been proposed to produce memory alloys of the Cu/Zn/Al type by powder metallurgy, starting with previously prepared alloys corresponding to the final composition (e.g., M. Follon, E. Aernoudt, Powder-metallurgically processed shape-memory alloy, 5th European Symposium on Powder Metallurgy, Stockholm 1978, pp. 275–281). The prepared powder is encapsulated, cold compacted, hot compacted and extruded. However, this method is not suited for the production of compact and dense finished articles of Cu/Al/Ni because the powder does not cohere and the compacts disintegrate.

Therefore a need has continued to exist for an improved method for preparing memory alloys of the Cu/Al/Ni system.

SUMMARY OF THE INVENTION

Accordingly, it is an object of the invention to provide a method for preparing memory alloys based on the Cu/Al/Ni alloy system.

A further object is to provide a method for preparing such alloys having a dense, compact structure and good mechanical properties together with accurately reproducible transition temperatures and memory properties.

A further object is to provide a method for preparing a memory alloy by powder metallurgy.

Further objects of the invention will become apparent from the description of the invention which follows.

According to the invention a memory alloy containing copper, aluminum, and nickel is prepared by a process which comprises the steps of:

(a) producing a powder A with a particle size of 10–200 $\mu$m of a copper-based pre-alloy containing 84–90% by weight Cu and the balance Al, producing a powder B having a particle size of 5–100 $\mu$m containing 95–99.5% by weight of aluminum and 0.5–5% by weight of copper, producing a powder C having a particle size of 10–100 $\mu$m from at least one metal selected from the group consisting of nickel, iron, manganese, and cobalt;

(b) preparing a mixture consisting essentially of 0.5–10% by weight of powder B, 0–6% by weight of powder C, and the balance powder A,;

(c) isostatically pressing said powder mixture at a pressure of at least 8000 bar, whereby a compact is produced;

(d) reducing and pre-sintering said compact produced in step (c) in a hydrogen or hydrogen/nitrogen atmosphere at 700°–1000° C. for at least 30 minutes;

(e) sintering the reduced and pre-sintered compact in an inert atmosphere at at least 700° C. for at least 10 hours;

(f) alternately hot working said compact at a temperature between 700° and 1000° C. and homogenizing said compact in an inert gas atmosphere at a temperature of at least 700° for at least 30 minutes;

(g) finally annealing said compact in an inert atmosphere at a temperature between 700° and 1050° C. for 10 to 15 minutes directly followed by quenching in water.

DETAILED DESCRIPTION OF THE INVENTION AND PREFERRED EMBODIMENTS

A key feature of the invention is the use as ingredients of neither powdered elemental metals nor powdered alloys having a composition corresponding to that of the final alloy, but rather a mixture of powdered pre-alloys and specially compounded powders chosen to give the desired final composition.

In this way, the ductility required for production of the memory alloys can be obtained without narrow limitations on the composition. Furthermore, the grain size of the final product can be for the most part predetermined, because grain growth is prevented by the presence of the finely divided oxide inclusions. On the other hand, oxide shells which impede homogenization and adversely affect the mechanical properties are avoided. To the extent that they are present (a small percentage) the oxides are in the form of finely divided inclusions dispersed in the matrix formed by the alloy, and have the effect of retarding grain growth. Thus they have a positive effect on the mechanical properties of the alloy.

Having generally described the invention, a more complete understanding can be obtained by reference to certain specific examples, which are provided herein for purposes of illustration only and are not intended to be limiting unless otherwise specified. In the examples all parts are by weight unless otherwise specified.

EXAMPLE I

A rod of a memory alloy having the following composition was produced:

| | |
|---|---|
| Aluminum: | 12.75% |
| Nickel: | 3% |
| Copper: | 84.25% |

The following powders were used as raw materials:

| | |
|---|---|
| Powder A: | Cupro-aluminum: 93% Cu; 7% Al, melted, atomized; grain size 40–100 $\mu$m; Manufacturer: Baudier. |
| Powder B | Aluminum premix 202 AC: 96% Al, 4% Cu; grain size 23–28 $\mu$m Manufacturer: Alcoa |
| Powder C | Pure nickel: 100% Ni, granular size 44 $\mu$m Mond-Nickel (e.g. Int. Nickel Co.) |

The following amounts were mixed for 10 minutes in a tumble mixer:

| | |
|---|---|
| Powder A: | 903.03 g |
| Powder B: | 66.97 g |
| Powder C: | 30 g |
| Total: | 1000 g |

240 g of this powder mixture were poured into a rubber tube with a diameter of 20 mm and isostatically pressed at a pressure of 8000 bar into an 18 mm diameter cylinder 220 mm high. The slug was reduced and presintered for 1 hour in a stream of hydrogen at a temperature of 950° C., and then the sintering was completed by heating for 19 hours at 950° C. in a stream of argon. The rough sintered billet was milled to a diameter of 17 mm, inserted into an annealed copper tube with a diameter of 20 mm and completely encapsulated by capping and soldering in an argon atmosphere. The work piece produced in this manner was alternately subjected to hot working and a homogenization annealing for 1 hour at 950° C. in a stream of argon. In this example the hot working consisted of rotary swaging at 950° C. whereby the diameter of the rod was reduced to 18 mm with the first swaging pass and an additional 2 mm with each additional pass. For every two hot working operations there was one homogenization annealing. When the rod had been reduced to 8 mm in diameter it was finally annealed in an argon stream for 15 minutes at 950° C. and immediately quenched in water. The density of the workpiece was 99.5–99.8% of the theoretical value.

Of course, the hot working/annealing cycle can be continued as long as needed to attain the final form of the workpiece. In general when this is done there is no need for an additional annealing after attaining the theoretical density.

EXAMPLE II

A rod was produced from a memory alloy having the following composition:

| | |
|---|---|
| Aluminum: | 13.5% |
| Nickel: | 4% |
| Copper: | 82.5% |

The powders listed under Example I were mixed in the following amounts for 15 minutes in a tumble mixer:

| | |
|---|---|
| Powder A: | 883.8 g |
| Powder B: | 76.2 g |
| Powder C | 40 g |
| Total | 1000 g |

240 g of this powder mixture were poured into an annealed copper tube 18 mm in diameter having a wall thickness of 2 mm, and completely encapsulated by capping the ends and soldering them shut in an argon atmosphere. Then the tube containing the powder was pressed isostatically at a pressure of 10,000 bar. The slug was reduced and presintered for 2 hours at 750° C. in a hydrogen/nitrogen stream and finally the sintering was completed by heating for 25 hours at 800° C. in an argon stream. Then the workpiece was alternately subjected to two circular swaging operations followed by a homogenization annealing at 900° C., as in Example I. When the rod had been swaged down to 6 mm it was subjected to a final annealing at 1000° C. for 10 minutes in a stream of argon and then quenched in water. The density was 99.5% of the theoretical value.

EXAMPLE III

A strip was produced of a memory alloy having the following composition:

| | |
|---|---|
| Aluminum: | 13% |
| Nickel: | 3% |
| Copper: | 84% |

The powders listed in Example I were mixed in the following amounts for 12 minutes in a tumble mixer:

| | |
|---|---|
| Powder A: | 900.2 g |
| Powder B: | 69.8 g |
| Powder C: | 30 g |
| Total: | 1000 g |

240 g of this powder mixture were poured into a heat softened tombac tube with an inside diameter of 20 mm and a wall thickness of 1.6 mm and completely encapsulated by capping the ends and soldering them shut in an argon atmosphere. Then, the tube and the powder were isostatically pressed at a pressure of 12,000 bar, and the slug was then reduced and presintered for 1.5 hours at 850° C. in a stream of hydrogen, and then the sintering was completed by heating for 22 hours at a temperature of 820° in an argon stream. Then the workpiece was reduced by two circular swaging passes at a temperature of 900° C. to 18 and 16 mm diameter respectively and homogenized for 1 hour at 920° C. in a stream of argon. The body was swaged two more times at 900° C. so that the final diameter of the rod was 13 mm. After another homogenization for 1 hour at 920° C. the rod was then rolled into a strip 1.5 mm thick and 20 mm wide by repeated hot rolling with each pass reducing the cross-section of the rod 20–25%. After a final annealing at 950° C. for 12 minutes the strip was quenched in water. The density of the finished strip was 99.7%.

EXAMPLE IV

A rectangular bar was produced from a memory alloy having the following final composition:

| | |
|---|---|
| Aluminum: | 12.75% |
| Nickel: | 4% |
| Copper: | 83.25% |

The powders mentioned in Example I were mixed in the following amounts for 10 minutes in a tumble mixer.

| | |
|---|---|
| Powder A: | 892.2 g |
| Powder B: | 67.8 g |
| Powder C: | 40 g |
| Total | 1000 g |

250 g of this powder mixture were poured into a rubber tube with an inside diameter of 35 mm and pressed isostatically at a pressure of 12,000 bar into a cylinder 31 mm in diameter and 80 mm in height. The slug was reduced and presintered for one hour at 920° C. in a stream of hydrogen and then finally sintered for 20 hours at 950° C. in a stream of argon. The rough sintered billet was turned to a diameter of 30 mm, placed in the chamber of a bar press and extruded into a square bar 8 mm on a side at a temperature of 780° C. The reduction ratio (reduction in cross-section) was 11:1. Then the bar was homogenized for 30 minutes at 920° C. and then drawn down to 6 mm on a side by two passes on a hot drawing bench at 750° C. After the final 900° C. annealing for 15 minutes in an argon stream the bar was quenched in water. The density of the finished bar was 99.8% of the theoretical value.

EXAMPLE V

A round plate was produced from a memory alloy having the following final composition:

| | |
|---|---|
| Aluminum: | 13% |
| Nickel: | 4% |
| Copper: | 83% |

The powders listed in Example I were mixed in the following amounts for 15 minutes in a tumble mixer:

| | |
|---|---|
| Powder A: | 889.4 g |
| Powder B: | 70.6 g |
| Powder C: | 40 g |
| Total: | 1000 g |

1000 g of this powder mixture were poured into a plastic tube with an inside diameter of 60 mm and pressed isostatically with a pressure of 12,000 bar into a cylinder 60 mm in diameter and 80 mm in height. The slug was reduced and presintered for 1 hour at 800° C. in a hydrogen/nitrogen stream and then finally sintered for 25 hours at 930° C. in a stream of argon. The rough sintered billet was turned to a diameter of 58 mm, placed in an annealed canister of soft iron with an outer diameter of 64 mm and totally encapsulated by fitting a cap thereto and soldering it shut in an argon atmosphere. The workpiece produced in this manner was subjected to hot forging, interrupted by homogenization annealings. Successive steps of forging and heating to 900° C. reduced the height of the cylinder to about 32 mm. The material was compacted to ca. 95% of the theoretical density and at this point had a diameter of 70 mm which corresponded to the height reduction. After an additional homogenization annealing for one hour at 950° C., the preformed circular plate with parallel flat frontal surfaces was placed in a forge die with offset diameters and worked down to final shape by several operations which were interrupted by intermediate annealings at temperatures between 1000° C. and 750° C. The 20 mm thick plate had a maximum outside diameter of 90 mm, a radial bulge on the upper side of 5×5 mm and on the bottom side a central recess 20 mm in diameter and 5 mm in axial depth. After a final annealing for 15 minutes at 980° C. the plate was quenched in water. The density was 99.2–99.5% of the theoretical value.

The invention is not restricted to the sizes and values given in the examples. Generally, the powder compositions and the particle sizes can be varied and substituted within the following ranges:

| | | |
|---|---|---|
| Powder A: | Pre-alloy | |
| | Copper: | 84–90% |
| | Aluminum: | Balance |
| | Particle size: | 10–200 μm |
| Powder B: | Pre-mix and/or pre-alloy (Alloyed mechanically or by fusion) | |
| | Aluminum: | 95–99.5% |
| | Copper: | 0.5–5% |
| | Particle size: | 5–100 μm |
| Powder C: | Pure metal (at least one present: substitution possible) | |
| | Nickel: | 0–100% |
| | Iron: | 0–100% |
| | Manganese: | 0–100% |
| | Cobalt: | 0–100% |

The powder mixtures can range within the following limits:

| | |
|---|---|
| Powder B: | 0.5–10% |
| Powder C: | 0–6% |
| Powder A: | Balance |

The powdered metal ingredients should be thoroughly mixed, preferably by mixing in a tumble mixer for at least ten minutes.

Pressures of at least 8000 bar are needed for isostatic pressing. The compact can be advantageously reduced and presintered in a temperature range of 700°–1000° C. for at least 30 minutes in a stream of hydrogen or hydrogen/nitrogen. The compact must be sintered above the temperature of eutectoid transition, i.e. at least 700° C. for 10 hours in an argon atmosphere, to assure as homogenous a texture as possible. The hot working consisting of press forging, hot extrusion, hot forging, hot rolling, hot drawing and/or hot swaging should be done between 700° and 1000° C., and the intermediate homogenization (intermediate annealing) in an inert gas atmosphere at at least 700° C. for at least 30 minutes. The final annealing in the argon stream is done at 700°–1050° C. ($\beta$-solid solution range) for 10–15 minutes and the workpiece is then immediately quenched in water.

For most types of hot working it is advantageous to encapsulate the material beforehand in a ductile, chemically non-reactive metal casing which forms a surface layer and finally mechanically or chemically removed after final forming. Annealed metals and alloys such as copper, copper alloys and soft iron are suitable as materials for the casing. Encapsulation can take place immediately before the hot working, in which case the surface of the sintered billet is mechanically prepared by turning, milling, planing, etc., or the powder can be placed directly into a suitable tube, canister, etc. instead of into a rubber or plastic tube.

The powder metallurgical method according to the invention makes it possible to produce work pieces from a memory alloy of the Cu/Al and Cu/Al/Ni type which, compared to the customary articles, i.e., those produced by melt alloying, have a fine grained texture and may contain inclusions in the form of finely dispersed oxide particles. The mechanical characteristics, particularly elongation, notch ductility and the workability of such workpieces are significantly better than those of articles which are cast and/or additionally hot worked. Thus, a new area of application is opened up for this type of alloy.

A comparison of this alloy with an alloy of 13% aluminum, 3% nickel and 84% copper produced by fusion serves to illustrate the differences mentioned above:

| | Casting | Invention Method |
|---|---|---|
| Grain Size (μ) | 1500 | 30 |
| Tensile Strength (MPa) | 440 | 540 |
| 0.2% Yield Strength (MPa) | 360 | 310 |
| Elongation (%) | 0.6 | 4.1 |
| Hardness HV10 (950° C./10'/WQ) | 180–210 | 250–280 |
| Work Output (MJ/m$^3$) (load 4 kg) | 1.23 | 3.38 |

Having now fully described the invention, it will be apparent to one of ordinary skill in the art that many changes and modifications can be made thereto without departing from the spirit or scope of the invention as set forth herein.

What is claimed as new and desired to be secured by Letters Patent of the United States is:

1. A method for producing a memory alloy based on copper, aluminum and metal selected from the group consisting of nickel, iron, manganese and cobalt, comprising the following steps:

(a) providing a powder A with a particle size of 10–200 μm of a copper based pre-alloy containing 84–90% by weight Cu, and the balance Al, providing a powder B having a particle size of 5–100 μm containing 95–99.5% by weight of aluminum and 0.5–5% by weight of copper, providing a powder C having a particle size of 10–100 μm from at least one metal selected from the group consisting of nickel, iron, manganese, and cobalt;

(b) preparing a mixture consisting essentially of 0.5–10% by weight of powder B, greater than 0 to 6% by weight of powder C, and the balance powder A;

(c) isostatically pressing said powder mixture at a pressure of at least 8000 bar, whereby a compact is produced;

(d) reducing and pre-sintering said compact produced in step (c) in a hydrogen or hydrogen/nitrogen atmosphere at 700°–1000° C. for at least 30 minutes;

(e) sintering the reduced and presintered compact in an inert atmosphere at at least 700° C. for at least 10 hours;

(f) alternately hot working said compact at a temperature between 700° and 1000° C. and homogenizing said compact in an inert atmosphere at a temperature of at least 700° C. for at least 30 minutes;

(g) finally annealing said compact in an inert atmosphere at a temperature between 700° and 1050° C. for 10 to 15 minutes directly followed by quenching in water.

2. The method of claim 1, wherein the sintered compact is machined before step (f) and is then encapsulated in a case of annealed copper, iron or a soft copper alloy.

3. The method of claim 2, wherein said machining comprises turning and the turned compact is introduced into an annealed copper tube and said tube is completely sealed by capping the ends and soldering them closed in an argon atmosphere.

4. The method of claim 1, wherein the isostatic pressing in step (c) takes place in a tube of annealed copper, iron or a soft copper alloy and said tube is mechanically or chemically removed only after step (g).

5. The method of claim 1, wherein the hot working of step (f) consists of press forging, hot extrusion, hammer forging, hot rolling, or hot drawing.

6. The method of claim 1, wherein the hot working of step (f) consists of swaging.

7. The method of claim 6, wherein the compact is rod-shaped, and during step (f) said compact is subjected alternately to two circular swaging passes followed by a homogenizing annealing at 950° C. in such a manner that a total of 6 circular swaging passes and 2 to 3 homogenizing annealings are carried out.

8. The method of claim 1, wherein the cycle in step (f) is continued as long as is necessary to reach the final form of the compact.

9. The method of claim 1 wherein the mixing in step (b) is conducted in a tumble mixer for at least 10 minutes.

* * * * *